US006969342B2

(12) United States Patent
Trovinger

(10) Patent No.: US 6,969,342 B2
(45) Date of Patent: Nov. 29, 2005

(54) SYSTEM FOR HANDLING FOLDED SHEET MATERIAL

(75) Inventor: Steven W. Trovinger, Los Altos, CA (US)

(73) Assignee: Hewlett-Packard Development Company, L.P., Fort Collins, CO (US)

( * ) Notice: Subject to any disclaimer, the term of this patent is extended or adjusted under 35 U.S.C. 154(b) by 109 days.

(21) Appl. No.: 10/084,459

(22) Filed: Feb. 28, 2002

(65) Prior Publication Data

US 2003/0162644 A1 Aug. 28, 2003

(51) Int. Cl.[7] ..... B31F 1/00
(52) U.S. Cl. ..... 493/405; 493/416; 493/436
(58) Field of Search ..... 493/405, 416, 493/436, 204, 196; 270/52.26, 32, 37

(56) References Cited

U.S. PATENT DOCUMENTS

| | | | | |
|---|---|---|---|---|
| 4,053,150 A | | 10/1977 | Lane | |
| 4,595,187 A | | 6/1986 | Bober | |
| 4,891,681 A | | 1/1990 | Fiske et al. | |
| 4,989,850 A | * | 2/1991 | Weller | 270/1.02 |
| 5,087,163 A | | 2/1992 | Erdbories et al. | |
| 5,100,118 A | * | 3/1992 | Hobbs et al. | 270/52.17 |
| 5,346,350 A | | 9/1994 | Luhman et al. | |
| 5,377,965 A | | 1/1995 | Mandel et al. | |
| 5,452,920 A | | 9/1995 | Parker | |
| 5,465,213 A | | 11/1995 | Ross | |
| 5,615,871 A | * | 4/1997 | Kleinhen | 270/45 |
| 6,099,225 A | | 8/2000 | Allen et al. | |
| 6,193,458 B1 | | 2/2001 | Marsh | |
| 6,363,851 B1 | | 4/2002 | Gerhard et al. | |
| 6,550,756 B2 | | 4/2003 | Trovinger | |
| 2002/0146302 A1 | | 10/2002 | Trovinger | |
| 2003/0161704 A1 | | 8/2003 | Trovinger | |
| 2003/0161705 A1 | | 8/2003 | Trovinger | |

FOREIGN PATENT DOCUMENTS

| | | |
|---|---|---|
| EP | 0399317 | 11/1990 |
| WO | WO0018583 | 4/2000 |
| WO | WO02078974 | 10/2002 |

OTHER PUBLICATIONS

Steven W. Trovinger et al., U.S. Appl. No. 09/831,768, filed May 14, 2001.

Steven W. Trovinger, U.S. Appl. No. 10/231,127, filed Aug. 30, 2002.

Steven W. Trovinger, U.S. Appl. No. 10/242,436, filed Sep. 13, 2002.

* cited by examiner

*Primary Examiner*—Sameh H. Tawfik

(57) ABSTRACT

A system for handling folded sheet material, including a rotatable clamping device including a linearly displaceable clamping component, and a collecting device shaped substantially as a saddle, where the rotatable clamping device is configured to simultaneously encompass opposing sides of the collecting device.

7 Claims, 8 Drawing Sheets

SYSTEM FOR HANDLING FOLDED SHEET MATERIAL

BACKGROUND OF THE INVENTION

1. Field of the Invention

The present invention relates generally to handling folded sheet material and, more particularly, to delivering and clamping sheet material on a collecting device using a rotatable clamping device.

2. Background Information

A system for making saddle-stitched booklets on a sheet-wise basis is disclosed in PCT No. WO 00/18583 (Trovinger et al., hereafter referred to as "the Trovinger PCT"), hereby incorporated by reference in its entirety. In this system, folded booklet sheets are forwarded from a folding device to a reciprocating saddle with the use of a secondary drive system. In such a forwarding system, the path of the sheets is a straight, horizontal line, while the folded sheets are accumulated in a vertical fashion (i.e., on the saddle), that is, normal to the sheet path. A reciprocating saddle as described in the Trovinger PCT permits a trailing side of a folded sheet to be transported onto the backside of a saddle.

SUMMARY OF THE INVENTION

The present invention is directed to a system for both moving folded sheets to a collecting device in a non-linear path, where each sheet is delivered to the collecting device such that a leading side and a trailing side of the sheet are respectively delivered to different sides of the collecting device, and for clamping the folded sheets against the collecting device.

According to an exemplary embodiment of the present invention, a system for handling folded sheet material is provided, including a rotatable clamping device including a linearly displaceable clamping component, and a collecting device shaped substantially as a saddle, where the rotatable clamping device is configured to simultaneously encompass opposing sides of the collecting device.

According to another embodiment of the present invention, a method for handling a folded sheet material in a booklet maker is provided, including the steps of clamping the folded sheet material with a rotatable clamping device, delivering the folded sheet material to a collecting device along an arc established by movement of the rotatable clamping device, the folded sheet material being deposited over a supporting edge of the collecting device such that a fold of the folded sheet material is supported by the supporting edge, and clamping the folded sheet material against different sides of the collecting device using the rotatable clamping device.

According to another embodiment of the present invention, a system for handling a folded sheet material is provided, including a saddle-shaped collecting device, and a rotatable clamping device for delivering the folded sheet material to the collecting device, the rotatable clamping device including a linearly displaceable clamping component and a fixed clamping component, where the displaceable and fixed clamping components press different portions of the folded sheet material against opposing sides of the collecting device simultaneously.

BRIEF DESCRIPTION OF THE DRAWINGS

Other objects and advantages of the present invention will become more apparent from the following detailed description of preferred embodiments, when read in conjunction with the accompanying drawings wherein like elements have been represented by like reference numerals and wherein.

DETAILED DESCRIPTION OF THE PREFERRED EMBODIMENTS

Figure 1A:
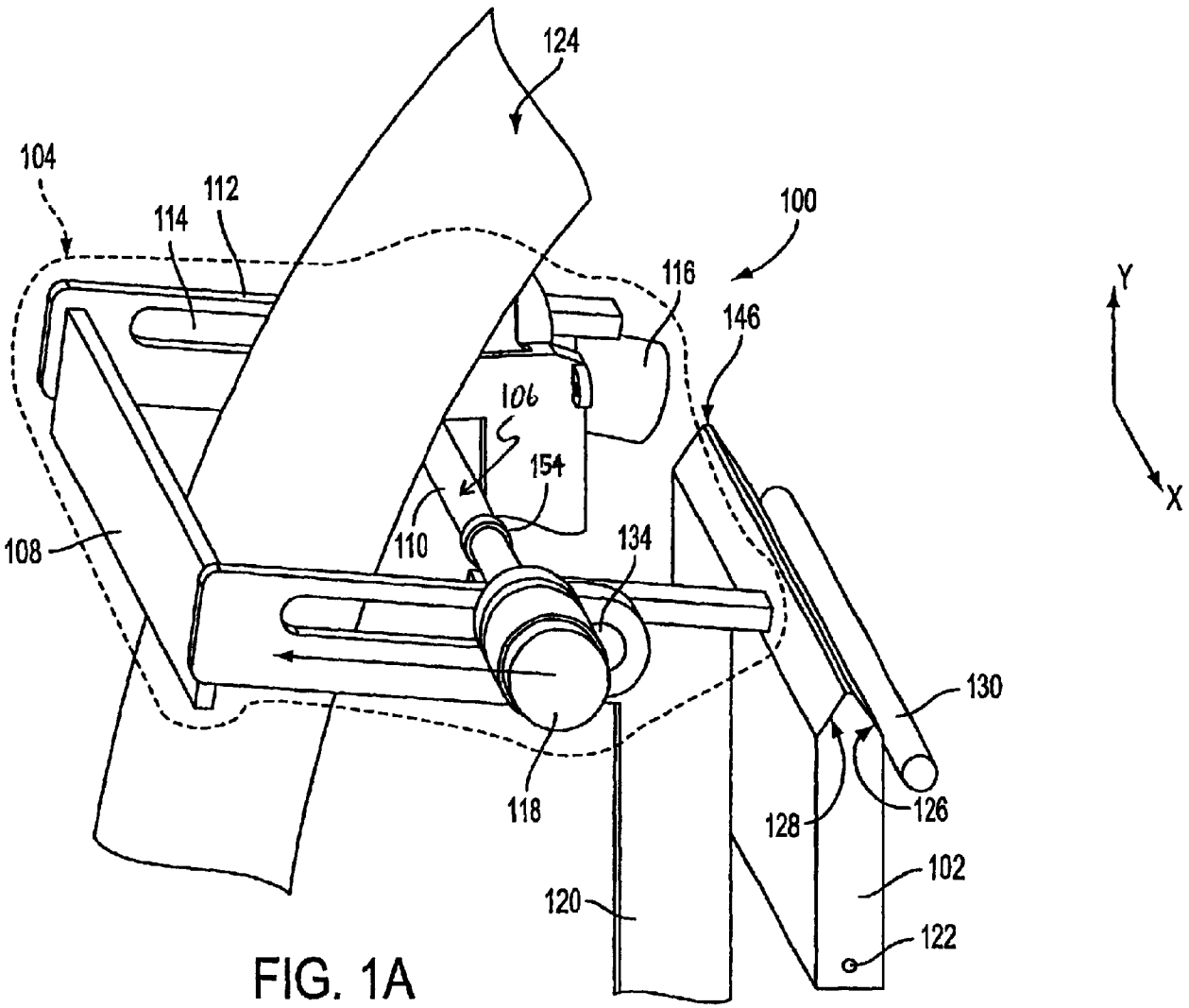
FIGS. 1A–1G are perspective views of a system for handling folded sheet material in different positions in accordance with an exemplary embodiment of the present invention.

A system for handling folded sheet material is represented by a handling system 100 as shown in exemplary FIG. 1A. The exemplary handling system (e.g., handling system 100) can be arranged within a larger apparatus, such as a sheet-wise booklet-making device.

The exemplary handling system includes a collecting device (e.g., collecting device 102) and a rotatable clamping device (e.g., rotatable clamping device 104). Collecting device 102 is shown in FIG. 1A as being saddle-shaped, and includes a top section shaped as an inverted-V, with a frontside 126, a backside 128, and a supporting edge 146. Frontside 126 and backside 128 represent opposing and different sides of collecting device 102, and can be arranged substantially parallel to each other (while converging at supporting edge 146) or can be alternatively arranged with any acute or obtuse angle between them. Alternatively, collecting device 102 be of any shape that is able to support folded sheets of material. Also, collecting device 102 can be made of metal, plastic, or any other formable material, and can also be a solid or hollow component.

Collecting device 102 is pivotable to a supporting edge (e.g., supporting edge 146) relative to rotatable clamping device 104. For example, collecting device 102 is rotatable about a pivot axle 122 (by any means for pivoting known in the art) such that supporting edge 146 can be moved away from or towards the axis about which rotatable clamping device 104 rotates. Further, collecting device 102 includes a collecting drive 130, which can be in the form of a roller (as shown in FIG. 1A) or any other means for driving and securing sheet material 124 against collecting device 102.

Rotatable clamping device 104 includes a linearly displaceable clamping component (e.g., displaceable clamping component 106) and a fixed clamping component (e.g., fixed clamping component 108). The rotatable clamping device of an exemplary embodiment of the present invention is also configured to simultaneously encompass opposing sides of a collecting device. That is, in at least one stage of a sheet delivery operation, clamping components of the rotatable clamping device are positioned such that they exert force (e.g., through different portions of a folded sheet) against opposing sides of a collecting device at the same time.

Figure 1B:
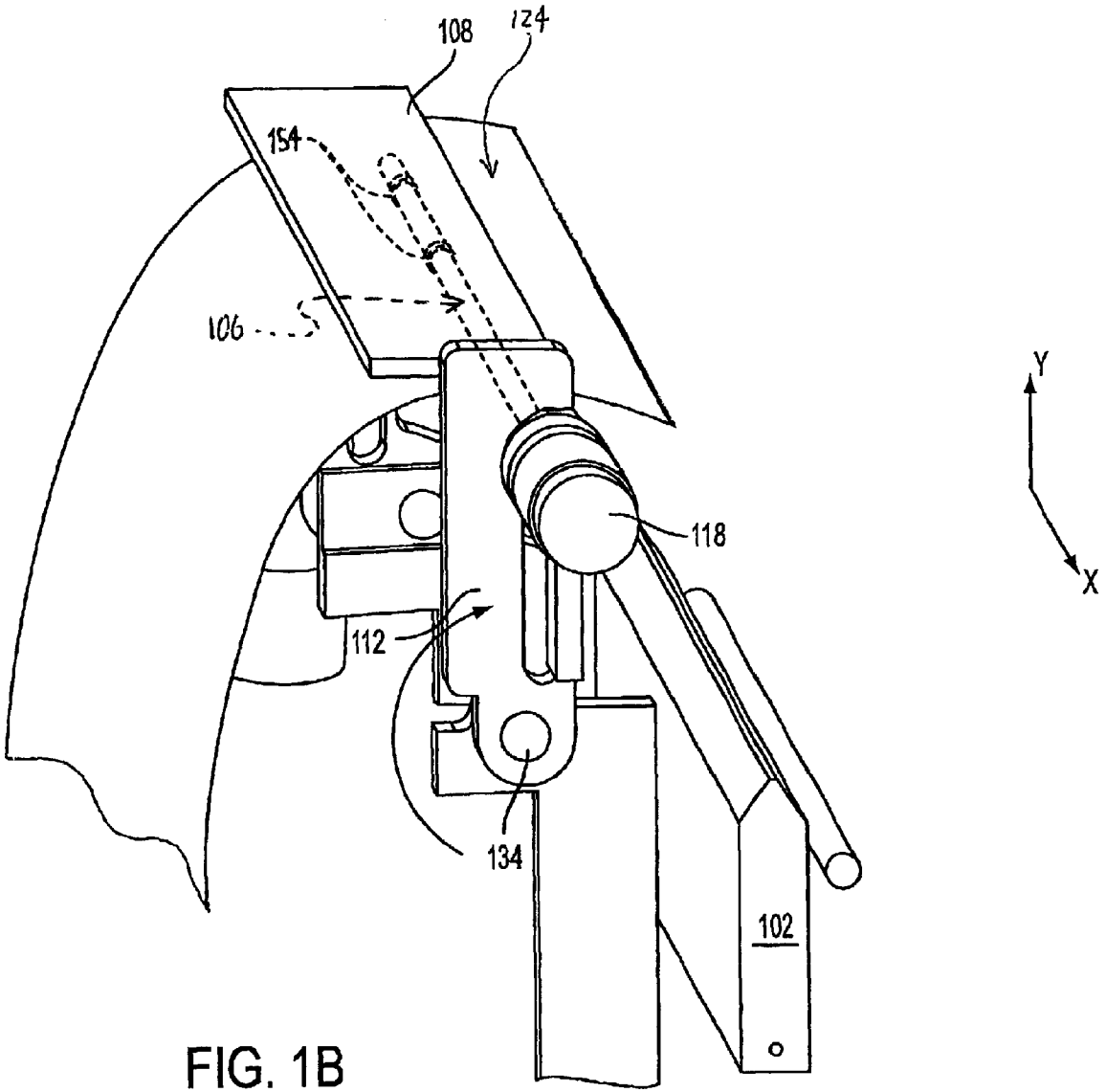
Figure 1C:
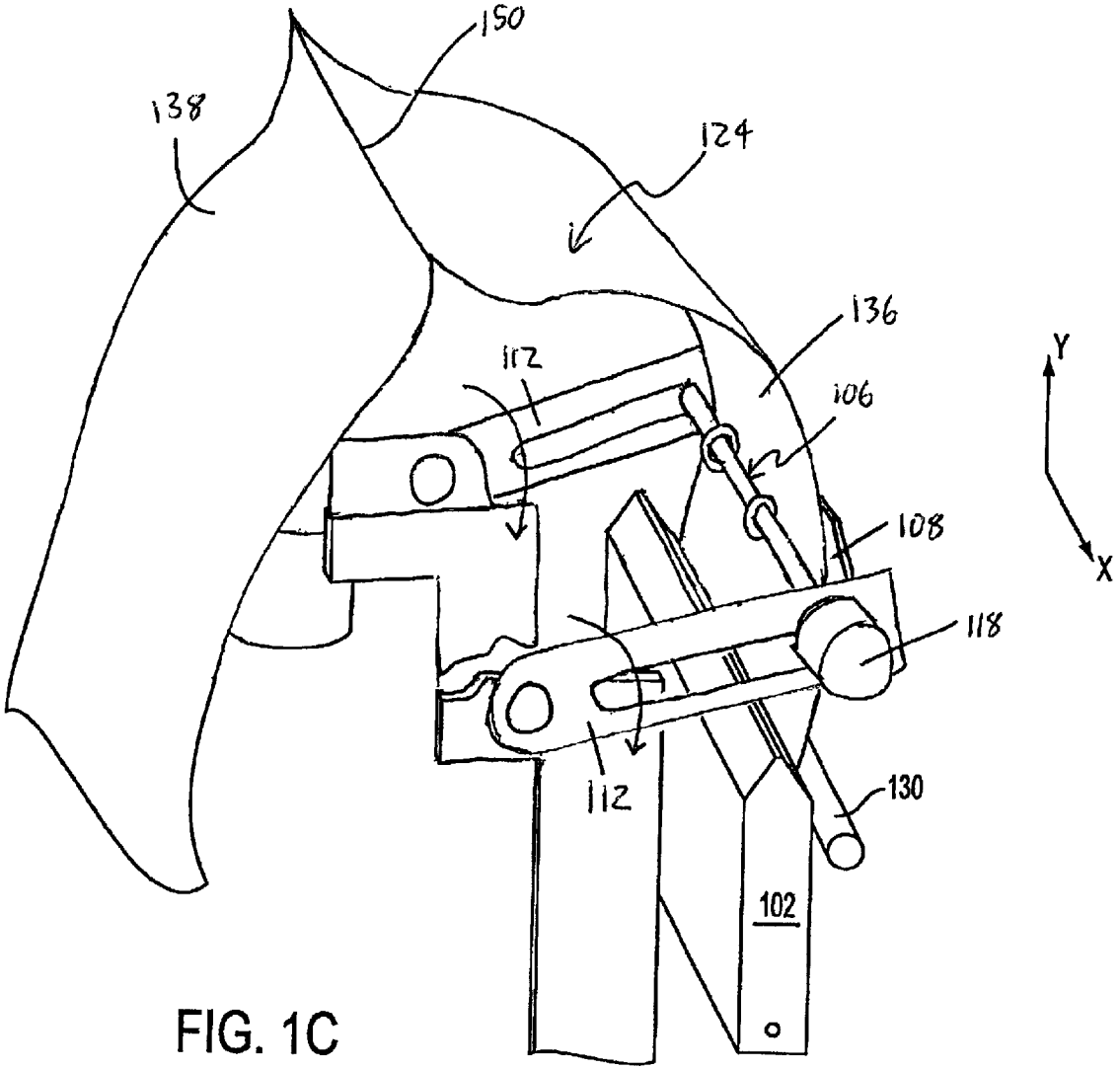
Figure 1D:
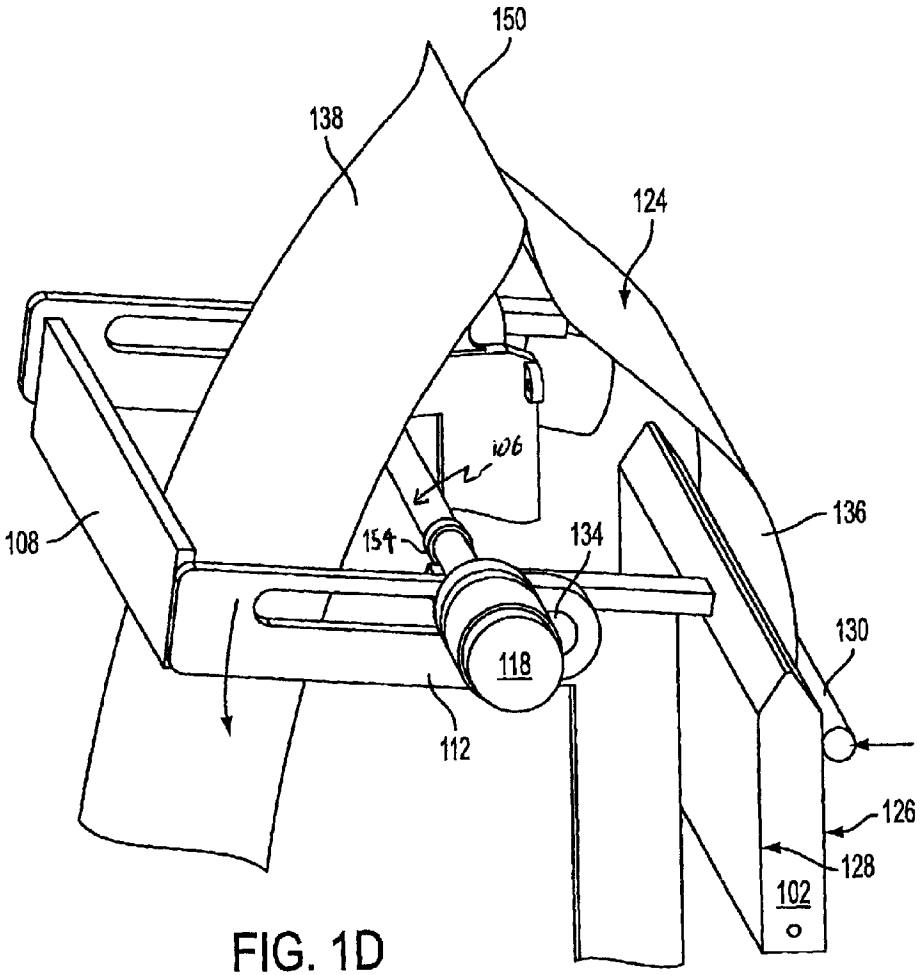
Figure 1E:
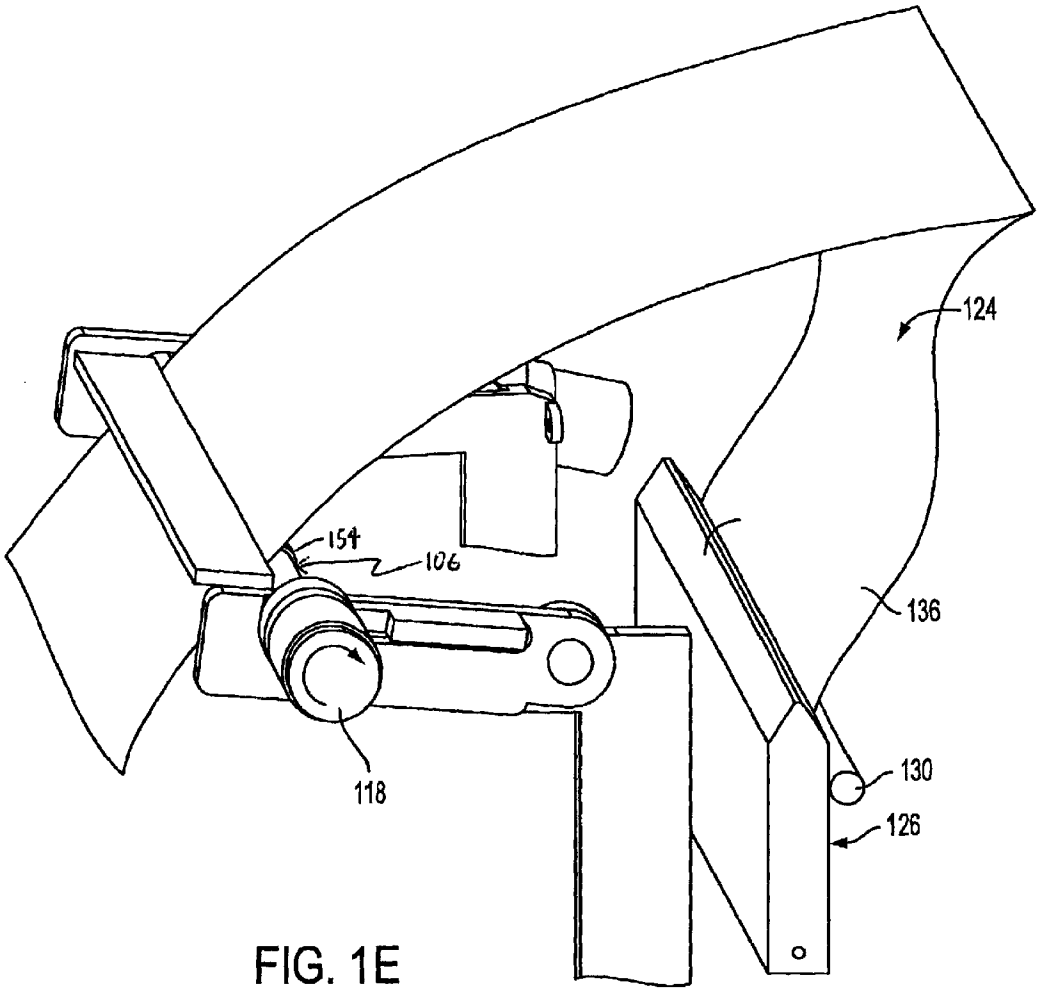
Figure 1F:
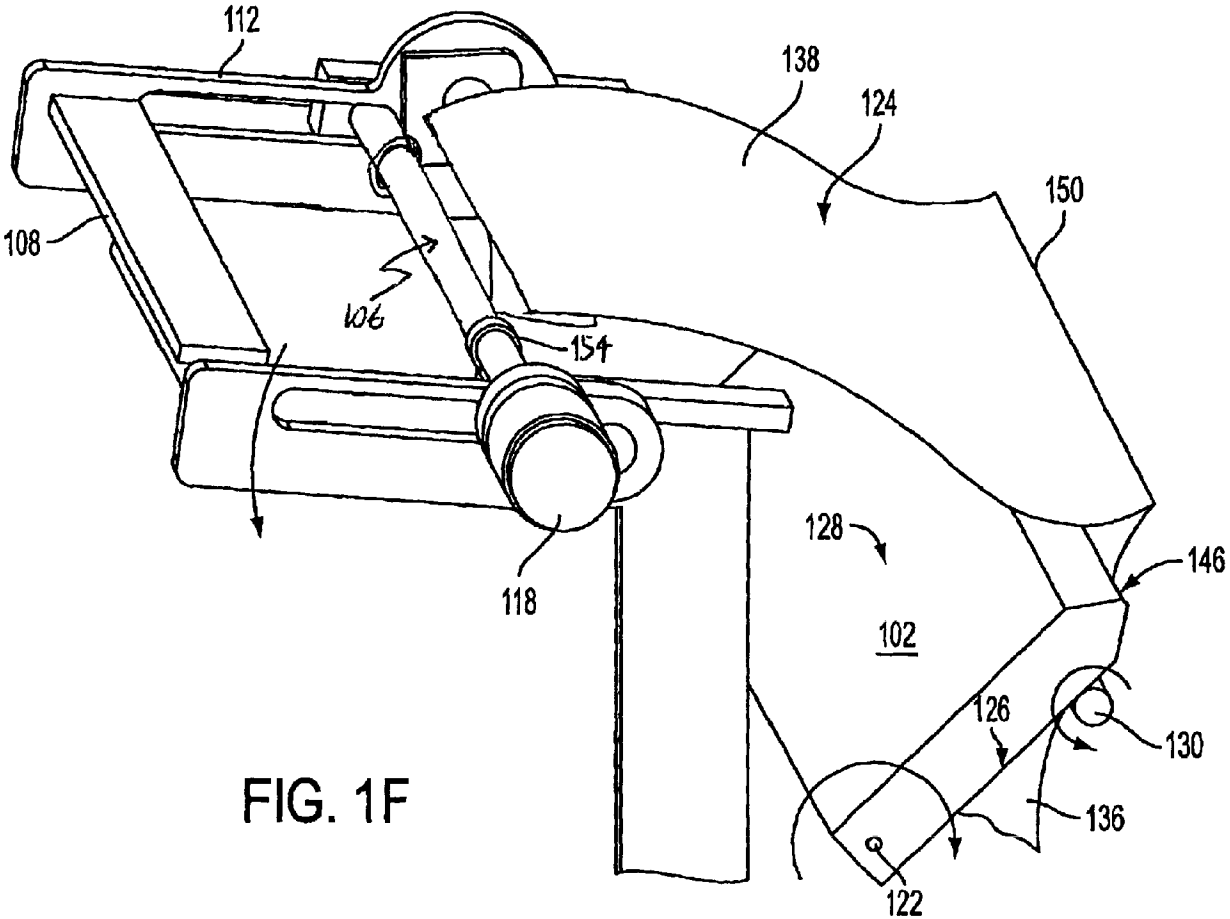
Figure 1G:
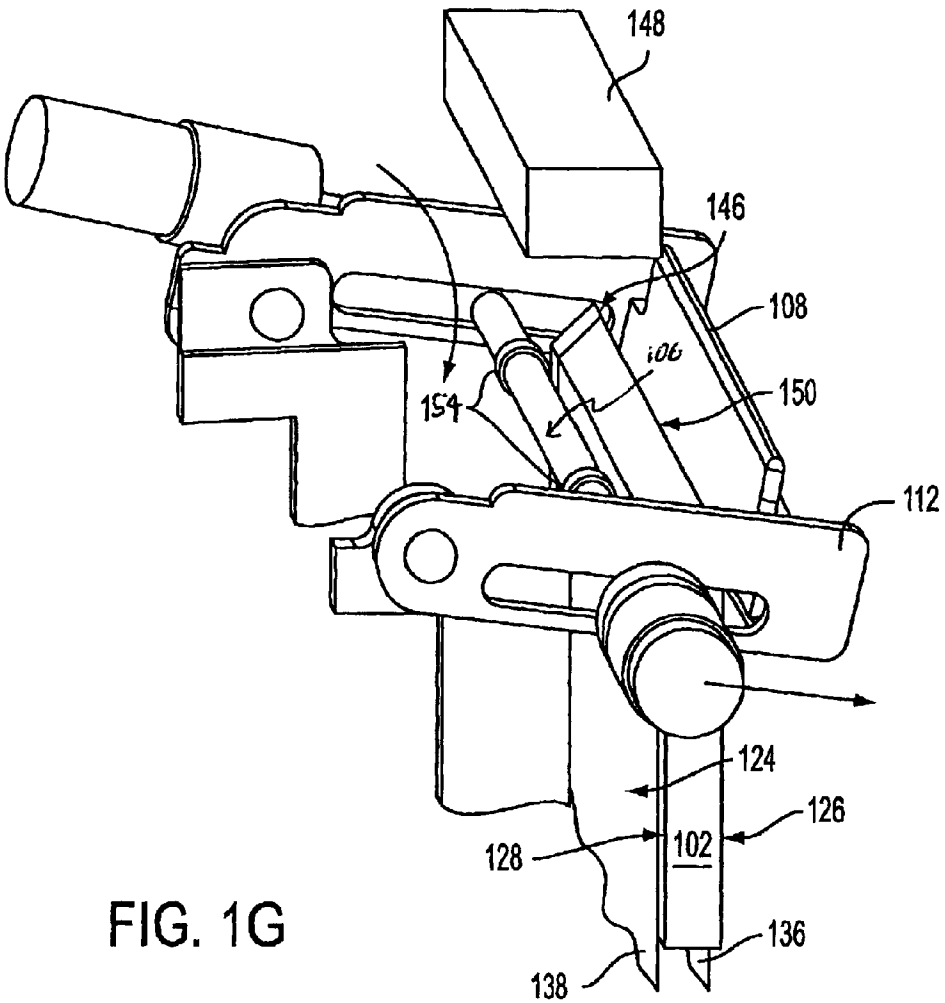

For example, in the FIG. 1G example, rotatable clamping device 104 is shown to be arranged such that displaceable clamping component 106 and fixed clamping component 108 are positioned on (and are able to press against) different and opposing sides of collecting device 102 at the same time. In this way, sheet material 124 can be secured against opposing sides 126 and 128 of collecting device 102 with the use of rotatable clamping device 104.

Figure 2:
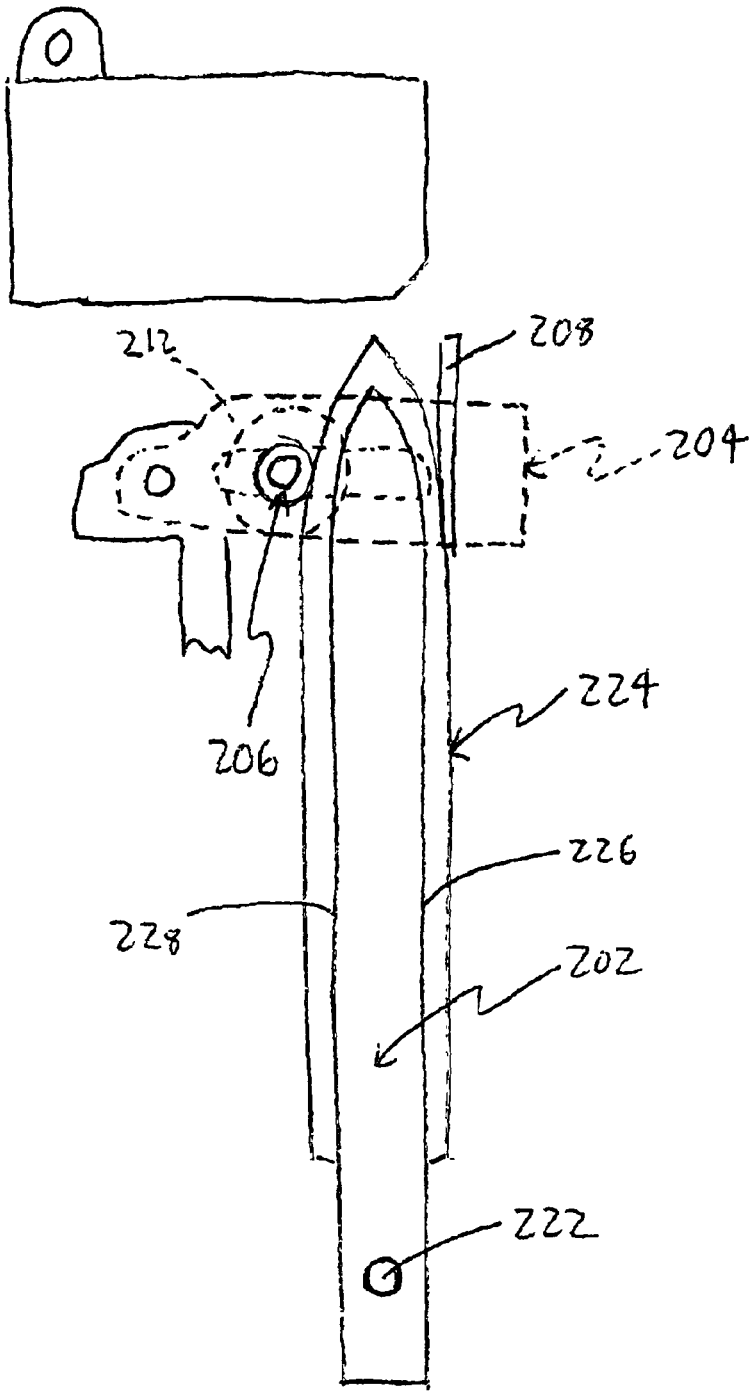
FIG. 2 is a side view of the exemplary embodiment shown in FIG. 1G.

This clamping function is also shown in side view in FIG. 2, where a stack of sheet material 224 is secured on opposite sides of collecting device 202 simultaneously by displaceable clamping component 206 and fixed clamping component 208.

Displaceable clamping component 106 includes drive tires 154 and a rotatable drive shaft 100, drive tires 154 being fixedly mounted on drive shaft 110. Drive shaft 110 (and drive tires 154 mounted thereon) can be rotated by a drive shaft motor 118 or, alternatively, by any means for rotating. Each drive tire 154 has a circular peripheral surface or, alternatively, can be of any other shape. Also, each drive tire 154 can be made of rubber, plastic, or any other formable material. Fixed clamping component 108 is arranged in the FIG. 1A example as a flat plate, but can alternatively be arranged as any other shape capable of securing sheet material 124 against drive tires 154. Fixed clamping component 108 can be a rigid component, and can be made of metal or any other formable material.

Rotatable clamping device 104 also includes a rotatable arm (e.g., one of arms 112) that rotates to deliver sheet material to collecting device 102. As shown in the FIG. 1A example, fixed clamping component 108 is fixedly mounted at one end of each arm 112, while the other end is pivotably attached to a support 120 at pivot points 134. Arms 112 can be arranged as two components (as shown in the figures) or can alternatively be of any number. Arm 112 includes guide slots 114 in which drive shaft 110 travels (i.e., in response to an operation of drive shaft motor). Guide slots 114 can be arranged linearly (as shown in FIGS. 1A–1G) or can, alternatively, include any amounts of curvature. Arms 112 can be rotated by any means for rotating (e.g., a gear rack and motor assembly).

During an operation where sheet material is to be clamped within rotatable clamping device 104, displaceable clamping component 106 is moved (via motor 116) towards fixed clamping component 108 along guide slots 114 until sheet material 124 is secured between drive tires 154 and fixed clamping component 108. Once sheet material 124 is clamped against fixed clamping component 108, displaceable clamping component 106 can rotate to drive sheet material 124 along fixed clamping component 108. In this way, rotatable clamping device 104 can be used to both secure and drive sheet material 124.

Also, alternatively, displaceable clamping component 106 can be rotatably attached to a lever, which is in turn rotatably attached to an arm such as arm 112. In such a configuration, displaceable clamping component 106 can secure sheet material 124 against fixed clamping component 108 by rotation of the lever. Displaceable clamping component 106 and fixed clamping component 108 can, alternatively, be arranged as any means for clamping of sheet material 124.

In exemplary FIGS. 1C–1G, sheet material 124 is a folded sheet, and a leading side and a trailing side of the sheet material (e.g., leading and trailing sides 136 and 138, respectively, in FIG. 1C) are respectively delivered to a frontside and a backside of the collecting device (e.g., frontside 126 and backside 128, respectively). An example of this process is explained below with reference to FIGS. 1A–1G. Alternatively, the process of sheet delivery described in U.S. patent application Ser. No. 09/820,740 (Trovinger), the disclosure of which is hereby incorporated by reference in its entirety, filed on Mar. 30, 2001, and entitled "APPARATUS FOR ADVANCEMENT OF PAPER IN A NON-LINEAR PATH", can be performed.

In the FIG. 1A example, rotatable clamping device 104 rotates about an axis parallel to supporting edge 146. Rotatable clamping device 104 rotates about pivot points 134, which lie along the x-axis shown in FIG. 1A, although the present invention is not limited to this orientation. For example, pivot points 134 can be arranged along the y-axis in FIG. 1A or any other axis. Also, collecting device 102, shown in FIG. 1A as having the length of its supporting edge 146 arranged along the x-axis, can be arranged in any orientation (e.g., the y-axis or any other axis). Rotatable clamping device 104 is shown to extend across the entire width of sheet material 124. That is, the distance between arms 112 is greater than the width of sheet material 124 along the x-axis of FIG. 1A), where pivot points 134 are located away from the edges of sheet material 124. This arrangement leaves a middle area clear for moving the trailing edge of a folded sheet onto collecting device 102.

As shown in FIGS. 1A–1G, rotatable clamping device 104 receives sheet material 124 while in a load position, delivers sheet material 124 as a folded sheet to collecting device 102 while in an unload position, and secures sheet material 124 against collecting device 102 while in a clamping position (this is also shown in FIG. 2). That is, these figures represent a movement of rotatable clamping device 104 along a rotational path to deliver sheet material 124 to collecting device 102, such that different portions of the folded sheet (e.g., leading and trailing sides 136 and 138) are respectively delivered to opposing sides of collecting device 102. The use of the exemplary rotatable clamping device has the advantage of saving space by directing individual booklet sheets in a non-linear (e.g., rotational) path. As this path is "folded back on itself", a more compact sheet-wise booklet making system is provided. Also, the securing of sheet material 124 against collecting device 102 can be performed by the same component, that is, rotatable clamping device 104.

FIG. 1A illustrates rotatable clamping device 104 in a loading or first position, where sheet material 124 is advanced by an upstream device, such as a main drive, into rotatable clamping device 104. At this point, sheet material 124 can already include an established fold 150 or can be unfolded. In FIG. 1A, displaceable clamping component 106 is positioned away from fixed clamping component 108. This allows sheet material 124 to be advanced into rotatable clamping device 104 and to pass between fixed clamping component 108 and displaceable clamping component 106.

The exemplary method includes a step of clamping a folded sheet material with a rotatable clamping device (e.g., rotatable clamping device 104). In FIG. 1B, displaceable clamping component 106 is moved against fixed clamping component 108 (via motor 116), thereby achieving a closed position and clamping a portion of sheet material 124 against fixed clamping component 108. Arm 112 then rotates about pivot points 134 towards collecting device 102, stopping at an intermediate position while rotatable clamping device 104 maintains a clamping force on sheet material 124. At the intermediate position shown in FIG. 1B, a fold 150 (shown in FIG. 1C) can be formed in sheet material 124, for example, by a folding apparatus (e.g., if a fold does not already exist on sheet material 124 or if another fold is desired).

A step of delivering a folded sheet material to a collecting device (e.g., collecting device 102) along an arc established by movement of the rotatable clamping device (e.g., rotatable clamping device 104 in FIG. 1C) is also provided, where the folded sheet material is deposited over a supporting edge of the collecting device such that a fold of the folded sheet material is supported by the supporting edge. As shown in the FIG. 1C example, arms 112 are rotated from the intermediate position (shown in FIG. 1B) towards collecting device 102 such that leading side 136 of the clamped and folded sheet material 124 is delivered between collecting device 102 and collecting drive 130. Alternatively, while arm 112 is positioned in the intermediate position, drive shaft motor 118 can operate to rotate displaceable clamping component 106 such that leading side 136 of sheet material 124 is advanced toward collecting device 102 and such that leading side 136 passes between collecting device 102 and collecting drive 130 (which is positioned away from collecting device 102). In this alternate embodiment, drive shaft motor 118 suspends rotation of displaceable clamping component 106 before fold 150 reaches fixed clamping component 108. Further, folded sheet material 124 can be alternatively delivered to collecting device 102 in any other manner using rotatable clamping device 104.

As shown in FIG. 1D, collecting drive 130 is operated to secure leading side 136 against frontside 126. Then, motor 116 is operated to move displaceable clamping component 106 away from fixed clamping component 108, thereby releasing sheet material 124 (which is now secured to collecting device 102 by collecting drive 130). Arm 112 then rotates away from collecting device 102 and over fold 150 such that fixed clamping component 108 is positioned over trailing side 138.

Motor 116 operates to secure trailing side 138 against fixed clamping component 108 and to begin advancing sheet material 124 out of rotatable clamping device 104, as shown in FIG. 1E. During this step, collecting drive 130 maintains pressure against leading side 136 such that sheet material 124 is secured to frontside 126.

As shown in FIG. 1F, the transfer of sheet material 124 from rotatable clamping device 104 to collecting device 102 is completed. Collecting device 102 rotates about pivot axle 122 away from rotatable clamping device 104 as collecting drive 130 rotates to advance leading side 136 down frontside 126 such that fold 150 approaches and is eventually supported by supporting edge 146. At the same time, motor 116 operates to release trailing side 138 as arm 112 rotates further away from collecting device 102. This movement allows trailing side 138 to clear rotatable clamping device 104 (i.e., to exit the space between fixed clamping component 108 and displaceable clamping component 106) and to fall against backside 128, thus completing the hand-off. As disclosed in U.S. patent application Ser. No. 09/820,740, rotatable clamping device 104 can also be rotated to sweep trailing side 138 against backside 128. As shown in FIGS. 1A–1F, displaceable clamping component 106 and fixed clamping component 108 are positioned on a same side of collecting device 102 during delivery of sheet material 124.

Also provided is a step of clamping the folded sheet material against different sides (e.g., sides 126 and 128) of the collecting device using the rotatable clamping device. As shown in FIG. 1G, after sheet material 124 is positioned on collecting device 102 such that fold 150 is supported by supporting edge 146, arm 112 rotates towards collecting device 102 until rotatable clamping device 104 clamps sheet material 124 against frontside 126 and backside 128 of collecting device 102. FIG. 2 illustrates this clamping in side view, where arm 212 is rotated towards collecting device 202 such that rotatable clamping device 204 clamps a stack of sheet material 224 against frontside 226 and backside 228 of collecting device 202.

In FIG. 1G, displaceable clamping component 106 and fixed clamping component 108 are positioned on different sides of collecting device 102 during the clamping of sheet material 124. For example, rotatable clamping device 104 can be positioned such that fixed clamping component 108 secures leading side 136 against frontside 126 while displaceable clamping component 106 secures trailing side 138 against backside 128. Such clamping can occur after an alignment or jogging process on collecting device 102. In this way, a stapler, such as stapler 148, can properly staple sheet material 124 when sheet material 124 is clamped against collecting device 102. Thus, a single component such as rotatable clamping device 104 can be used to deliver sheet material 124 to collecting device 102 and to clamp sheet material 124 against collecting device 102.

Exemplary embodiments of the present invention can be modified to include features from any or all of the following copending applications, all filed on even date herewith, the disclosures of which are hereby incorporated by reference in their entirety: U.S. application Ser. No. 10/084,460, entitled "Booklet Maker", (Trovinger, S.); and U.S. application Ser. No. 10/084,462, entitled "Pivotable Collecting Device", (Trovinger, S.).

It will be appreciated by those skilled in the art that the present invention can be embodied in other specific forms without departing from the spirit or essential characteristics thereof. The presently disclosed embodiments are therefore considered in all respects illustrative and not restricted. The scope of the invention is indicated by the appended claims rather than the foregoing description and all changes that come within the meaning and range and equivalence thereof are intended to be embraced within.

What is claimed is:

1. A system for handling folded sheet material, comprising:

a rotatable clamping device including a linearly displaceable clamping component; and a collecting device shaped substantially as a saddle, wherein the rotatable clamping device is configured to simultaneously press against opposing sides of the collecting device.

2. The system of claim 1, wherein the rotatable clamping device includes a fixed clamping component.

3. The system of claim 2, wherein the rotatable clamping device is configured such that the displaceable clamping component and the fixed clamping component press against opposing sides of the collecting device.

4. The system of claim 1, wherein the rotatable clamping device rotates about a first axis parallel to a supporting edge of the collecting device.

5. The system of claim 1, wherein the displaceable clamping component is rotatable about a second axis parallel to the supporting edge.

6. The system of claim 1, wherein the collecting device is pivotable to move a supporting edge of the collecting device relative to the rotatable clamping device.

7. A system for handling a folded sheet material, comprising:

a saddle-shaped collecting device; and a rotatable clamping device for delivering the folded sheet material to the collecting device, the rotatable clamping device including a linearly displaceable clamping component and a fixed clamping component, wherein the displaceable and fixed clamping components press different portions of the folded sheet material against opposing sides of the collecting device simultaneously.

* * * * *